US005177320A

United States Patent [19]

Reynolds

[11] Patent Number: 5,177,320

[45] Date of Patent: Jan. 5, 1993

[54] STAGED GAS SYSTEM

[76] Inventor: George L. Reynolds, R.R. #1, Altona, Ill. 61414

[21] Appl. No.: 581,729

[22] Filed: Sep. 12, 1990

[51] Int. Cl.[5] ..... F41A 5/22

[52] U.S. Cl. ..... 89/193

[58] Field of Search ..... 89/193, 191.01

[56] References Cited

U.S. PATENT DOCUMENTS

| | | | |
|---|---|---|---|
| 2,409,225 | 10/1946 | Schaich | 89/193 |
| 2,800,059 | 7/1957 | Miller | 89/193 |
| 2,987,968 | 6/1961 | Janson | 89/193 |
| 3,024,706 | 3/1962 | Wild | 89/193 |
| 3,715,955 | 2/1973 | Folley et al. | 89/193 |
| 3,982,468 | 9/1976 | Browning | 89/193 |
| 4,702,146 | 10/1987 | Ikeda et al. | 89/193 |

FOREIGN PATENT DOCUMENTS

| | | | |
|---|---|---|---|
| 1405289 | 9/1975 | United Kingdom | 89/193 |

*Primary Examiner*—Michael J. Carone
*Attorney, Agent, or Firm*—Robert O. Richardson

[57] ABSTRACT

As the primary mass is driven by gas trapped from the barrel of a weapon being fired, it unlocks the bolt and carries it rearward to start the cycling action to operate the weapon. Until the bolt is unlocked a smaller area of the primary mass is exposed to the gases and a larger area is used after the unlocking and the secondary mass is contacted.

3 Claims, 5 Drawing Sheets

STAGED GAS SYSTEM

BACKGROUND OF INVENTION

The highest cyclic rate gas operated single barrel weapons firing conventional cartridges utilize a primary mass (called an actuator or bolt carrier) which are directly, or indirectly, driven by gas tapped from the barrel. The kinetic energy of the primary mass (derived from the gas from the barrel) serves to unlock the bolt (secondary mass) and to carry the combined primary/-secondary mass rearward to operate the weapon.

It is well known that when the primary mass contacts, unlocks and picks up the secondary mass, that there is a significant drop in velocity of the combined primary/secondary mass as compared to the velocity of the primary mass before impact with the secondary mass.

It is also well known that the upper limit of cyclic rate is governed by, among other things, the highest velocity at which a spring can be compressed without damaging the spring.

This means that the cyclic rate of a gas operated weapon is limited by the velocity of the operating parts, which is in turn, governed by the loading velocity of the spring. Since the initial velocity of the primary mass is limited by the loading velocity which the spring can tolerate, it follows that the velocity of the combined primary/secondary mass will be somewhat below the maximum loading velocity which the spring can tolerate, resulting in a slower cycle time than if the operating parts could continue at the initial velocity of the primary mass.

A number of attempts have been made to develop low velocity grenade launchers employing gas powering systems. These have not been successful because conventional gas systems have been employed. Conventional gas systems are well suited for weapons employing typical (say 50,000 psi) cartridges but such systems only extract a very small percentage of the gas generated in firing. In conventional systems, a small percentage of the gas is adequate because the gas is at very high pressure and contains a relatively great amount of energy. In contrast to typical cartridges, the pressure in a grenade launcher barrel just ahead of the chamber may be less than 5,000 psi. In addition to the very low initial pressure, what little pressure there is, decrease very quickly due to the low quantity of powder consumed and the very high expansion ratios associated with grenade launcher systems. This means that in order for a gas system to operate properly under such conditions, a relatively large percentage of gas generated must be quickly trapped, and then the energy in the trapped gas must be efficiently extracted. The subject invention accomplishes these ends.

SUMMARY OF THE PRESENT INVENTION

The purpose of this invention is to provide a gas powering system which will provide a relatively small force through an initial travel, and then provide a relatively larger force after this until the gas pressure diminishes through expansion.

In the practice of the present invention the cyclic rate of high cyclic rate operating mechanisms in gas operated weapons is increased. It has equal application in low chamber pressure weapons such as grenade launchers as a means for harnessing the energy from a relatively large volume of low pressure gas generated from firing the weapon, and it can be applied to weapons in which low mass of the operating mechanism is required. The present invention provides a means for maintaining high bolt and carrier velocity throughout the recoil stroke resulting in a shorter cycle time, and thus a higher mechanism cyclic rate. This invention provides a means whereby the initial velocity of the primary mass is retained in the combined primary/secondary mass. The invention provides a means whereby the area of the gas system exposed to gas for operating the weapon is provided proportional to the mass of the parts being driven. The area of the gas system exposed to the pressurized gas is designed such that when only the primary mass is being driven, the primary mass will be accelerated to close to the critical velocity of the spring. Then when the primary mass contacts, unlocks and picks up the bolt (secondary mass) the area being acted upon by the gas is increased in accordance with the increase in mass being acted upon.

This system eliminates the need to provide a large primary mass for storing kinetic energy to operate the weapon. Instead of using a large primary mass, a relatively large amount of pressurized gas is trapped in the gas system, and then the gas is allowed to expand and to directly provide power throughout most of the rearward travel of the recoiling parts. This is of special importance where light weapon weight is required.

In order to provide the initial small force, gas is trapped within the gas piston. The gas travels from the bore, in one embodiment, through a gas port equipped with a one-way valve, and into the gas piston. The one-way valve prevents the gas from escaping back into the bore after the projectile leaves the bore, even if the operating parts are temporarily binding due to elastic flexure of the mechanism due to firing stresses. The pressuriaed gas trapped in the gas piston initially acts only against its own interior and on the portion of the gas cylinder plug exposed to the gas.

During the initial movement of the gas piston, when only the small diameter of the gas cylinder plug is acted upon by the pressurized gas, the only work being done by the gas piston is to unlock the breech. The mechanism is designed such that at the same time the gas piston passes the small diameter projection of the gas cylinder plug, and the breech has been unlocked, the operating rod contacts the bolt. The gas now acts upon the full diameter of the gas piston, increasing the force on the gas piston. The full force of the gas is then applied through the piston to the bolt. This larger force continues to drive the piston and the bolt rearward. The force diminishes in proportion to the expansion of the gas. The specific smaller and larger forces used in a weapon operating system are controlled by design parameters of the components. When the piston approaches its rearmost position, the gas is released through a vent from the gas cylinder to the atmosphere. This vent can be designed in such a way as to direct the exhaust gasses away from the operator. Gas is prevented from entering the receiver and also from enveloping the operator in exhaust gasses.

One basic feature of the invention is the staging of the force supplied by the gas system to tailor power applied to the operating mechanism according to the changing power requirements through the recoil stroke. It provides a small force through the distance required to unlock the breech, and then it provides a large force for opening the bolt, driving the feed mechanism, and operating other cycling functions.

The usual design practice is to provide sufficient structural stiffness to limit the flexure sufficiently to prevent binding of parts due to firing stress. But, due to the demand for lighter weapons, it is necessary to reduce the mass of weapon structures. It is desirable to design weapon structures somewhat upon aircraft design principles in which airframes are of adequate strength to function safely, while not being rigid. The invention provides a one-way valve in the gas port, so that even if the gas piston does not move rearward immediately to cut off the gas (as is common practice) the gas will be trapped anyway.

DETAILED DESCRIPTION OF ILLUSTRATIVE EMBODIMENTS

Figure 1:
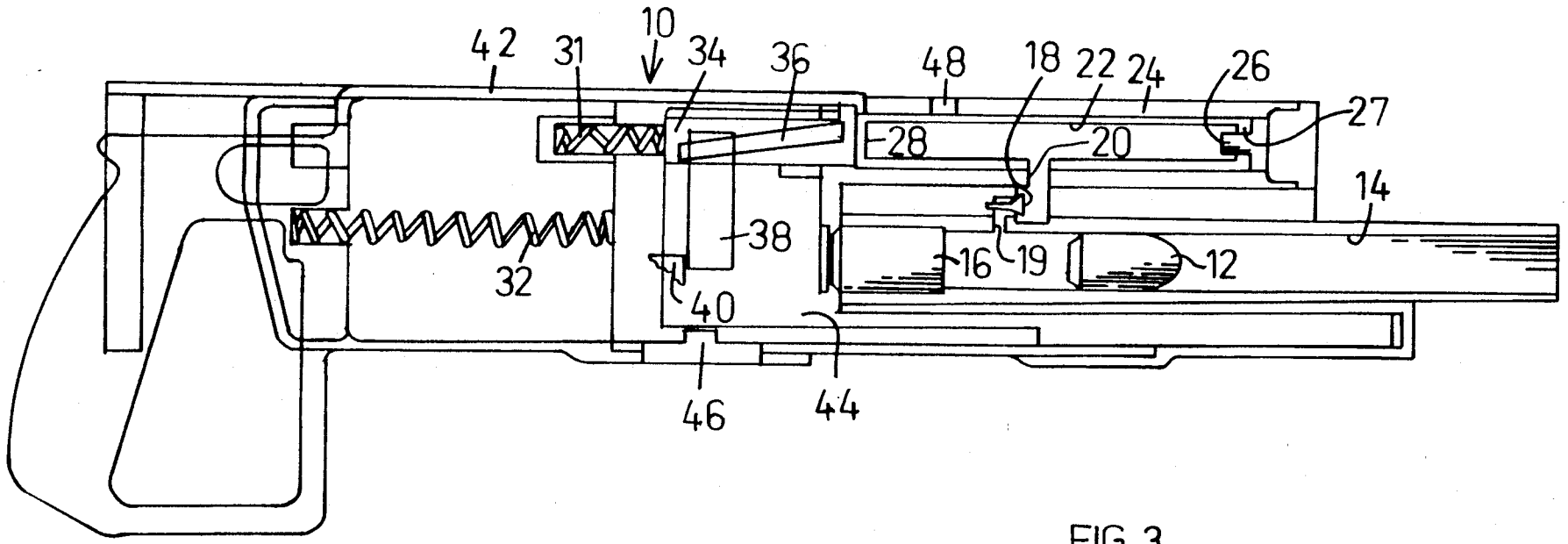
FIG. 1 is a schematic illustration of a weapon in battery position showing one form of the present invention.
Figure 2:
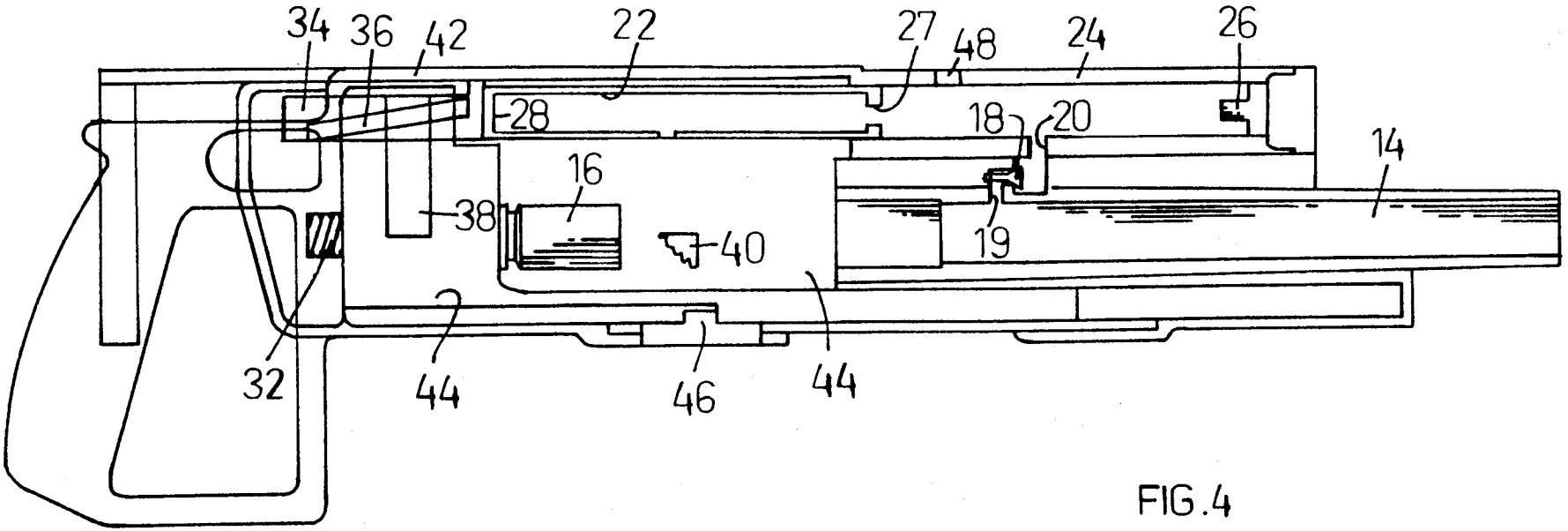
FIG. 2 is a similar illustration with the weapon in recoil position.

Reference is now made to FIGS. 1 and 2. in FIG. 1 the weapon (10) has just been fired and the projectile (12) is part way down the barrel (14). Gaseous pressure between casing (16) and projectile (12) passes through one-way valve (18) in barrel port (19), through piston gas port (20) and into gas piston (22) which is movable within gas cylinder (24). A gas cylinder plug (26) extends into an opening (27) at the front end of piston (22) and into the bore of the piston (22). Gas from barrel (14) thus enters the inside of the piston (22) and acts against end (28) of piston (22) and reacts against the projection of plug (26). This system can be designed to cause the piston (22) and operating rod (34) to be driven at close to the critical velocity of return spring (31). (This piston (22) compresses return spring (31) through operating rod (34)) The length of the projection on the plug (26) is such that when the primary mass contacts the secondary mass to pick up the secondary mass bolt (44) with lock (38), the front opening (27) of the piston passes the end of the projection on the plug (26). When the piston (22) passes the rear of the projection on the plug (26), the area being acted upon by the gas is abruptly increased to include the total frontal area of the piston. Simulatenously with this abrupt increase in force against the total frontal area of the piston, the incline (36) of the operating rod (34) has raised the lock (38) out of engagement with the stop (40) on the frame (42). This sharp increase in force applied to the piston maintains the velocity of the recoiling mass which is not both primary and secondary masses. In this way the velocity of the recoiling parts can be maintained at or near the critical loading velocity of the drive spring (32), providing the highest cyclic rate possible.

The initial volume is designed large to provide a low expansion ratio to maintain a relatively large force on the piston by the expanding gas, as the primary/secondary mass move rearward.

The rearward movement of piston (22) drives operating rod (34) rearwardly. An incline (36) on the rod raises lock (38) from its locked position in front of stop (40) on frame (42) to permit rearward movement of bolt (44) (secondary mass), extracting and ejecting the spent case. As shown in FIG. 2, bolt (44) engages feed slide (46), resulting in feeding of a fresh round. These results of rearward movement of piston (22) are conventional state-of-the-art practices and per se are not considered unique. Vent (48) in gas cyclinder (24) is vented to atmosphere to reduce resistance to return of recoiling parts to battery position. The vent also prevents filling the gun mechanism with exhaust gases which, under some conditions can cause secondary explosions in the weapon mechanism. The vent also can be designed to direct the exhaust gases away from the weapon crew.

Figure 3:
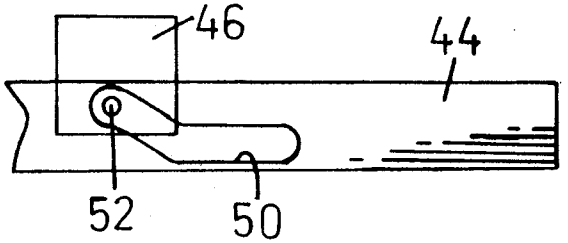
FIGS. 3 and 4 illustrate how the bolt actuates a feed slide when moving from battery to recoil position.
Figure 4:
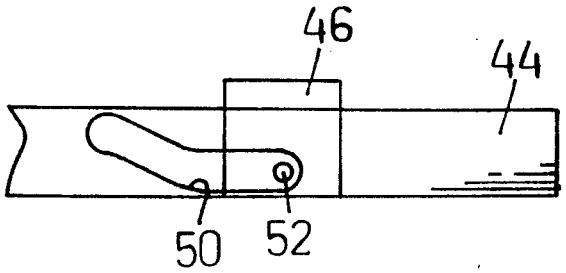

FIGS. 3 and 4 show actuating of the feed slide (46) resulting from rearward movement of bolt (44). Bolt (44) has a cam slot (50) in which lug (52) on feed slide (46) is positioned whereby rearward movement of bolt (44) results in lateral movement of feed slide (46).

Figure 5:
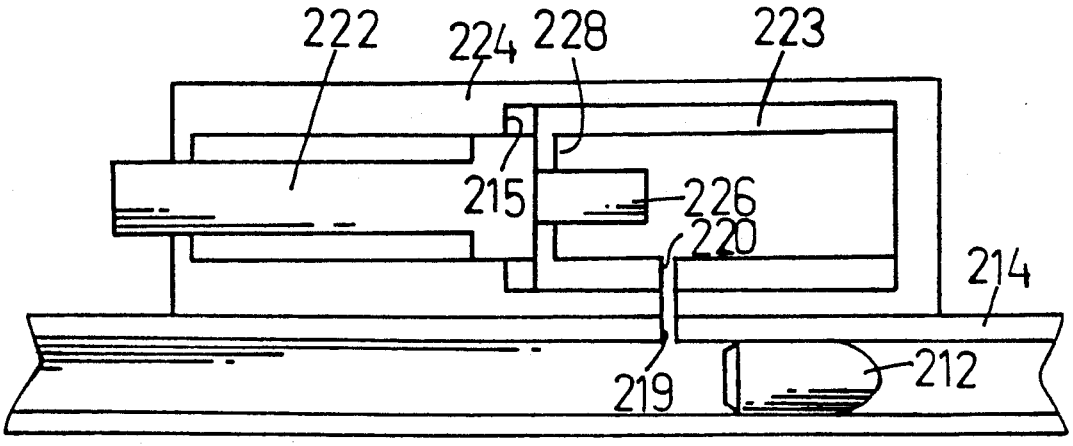
FIGS. 5, 6 and 7 illustrate the operation of a second embodiment.
Figure 6:
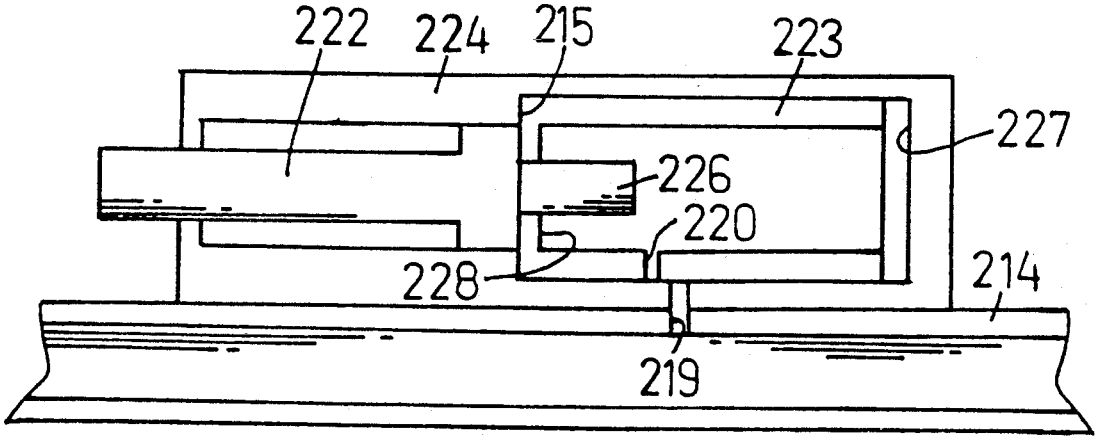
Figure 7:
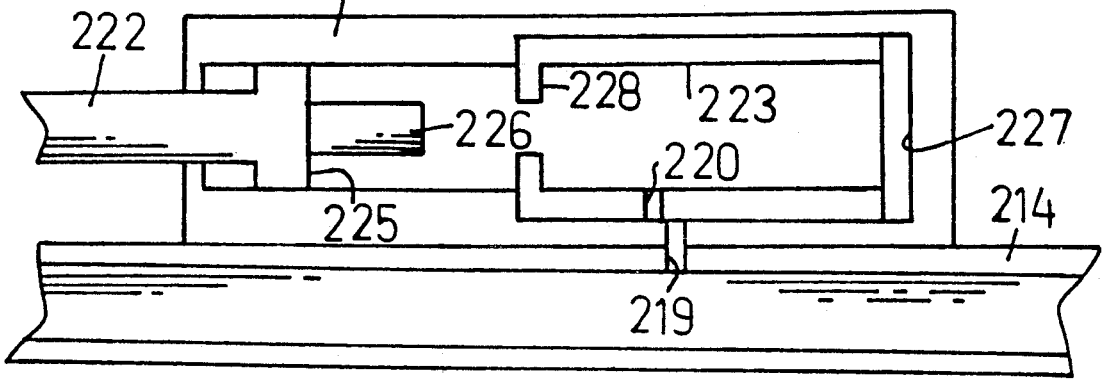

FIGS. 5, 6 and 7 illustrate a second embodiment. In FIG. 5 projectile (212) has passed beyond barrel port (219) in barrel (214). Port (220) in primary piston/valve (223) is aligned with port (219), permitting pressure gases to enter primary piston/valve (223). Primary piston/valve (223) is shorter than its gas chamber (227) so that gas pressure on the total frontal area of the gas will move the primary piston/valve (223) to the left only a short distance as shown in FIG. 6. This moves port (220) out of alignment with port (219) trapping gas within the primary piston/valve (223). Meanwhile, pressure is also applied to secondary piston plug (226) that protudes through cyclinder end (228) of primary piston/valve end. This drives secondary gas piston (222) further to the left as shown in FIG. 7 after the cylinder (224) has stopped. As plug (226) is freed from end (228) of primary piston/valve (223) the remaining piston surface (225) is also exposed to gas pressure. Secondary piston (222) actuates cyclical movements which need not be described here as they are already well known. This pressurization of surface (225) coordinates the gas pressure with that which is needed to cause the functioning of cyclical movements for optimun usage.

The alternative shown in FIGS. 5,6 and 7 employs a primary piston/valve (223) and secondary piston (222). At rest, the secondary piston bears against the primary piston/valve (223). When the weapon is fired, gas enters the body of the primary piston/valve (224) and pressurizes the system as in FIG. 5. The gas pressure acting on the total frontal area of the primary piston/valve (223), and upon the small diameter of the secondary piston plug (226) provides a very sharp rearward force on the secondary piston (222). This causes a very rapid acceleration of the operating parts. As the primary piston/valve (223) moves to the position in FIG. 6 the gas port (220) is closed to the barrel (214), trapping the pressurized gas valve (223). A shoulder (215) in the gas cyclinder (224) prevents further rearward movement of the primary piston/valve (223). The small diameter of the secondary piston plug (226) is designed to maintain the high velocity imparted by the primary piston/valve (223), but not to increase the velocity of the secondary piston (222). The small diameter of the secondary piston plug (226) passes the rear of the primary piston/valve (223) at the same moment the rear of the secondary gas piston (222) completes unlocking and contacts and picks up the bolt, not shown in FIGS. 5,6 and 7. In FIG. 7 the area being acted upon by the gas trapped in the gas system has increased from the small diameter of the secondary piston plug (226) to the full diameter (225) of the secondary gas piston (222). This provides a strong force to maintain the maximum velocity of the operating parts to recoil position.

Figure 8:
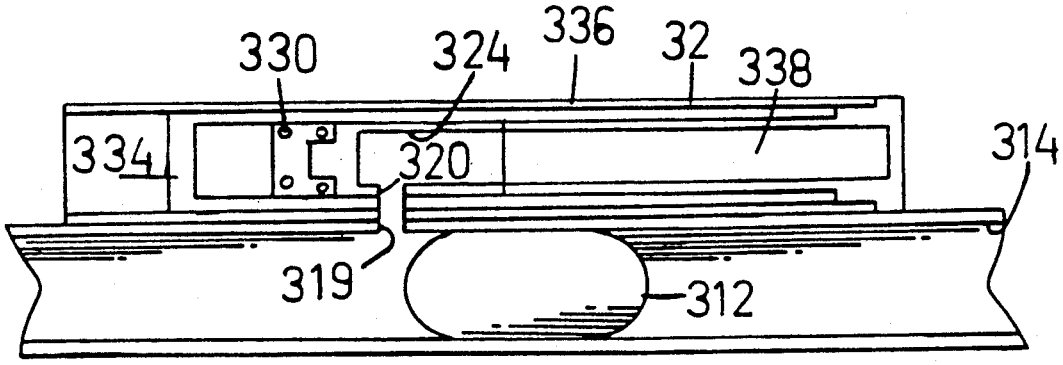
FIGS. 8, 9 and 10 illustrate the operation of a third embodiment.
Figure 9:
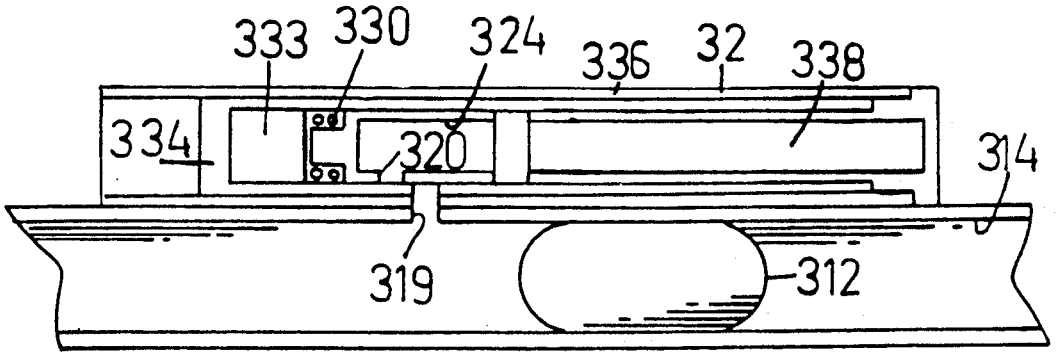
Figure 10:
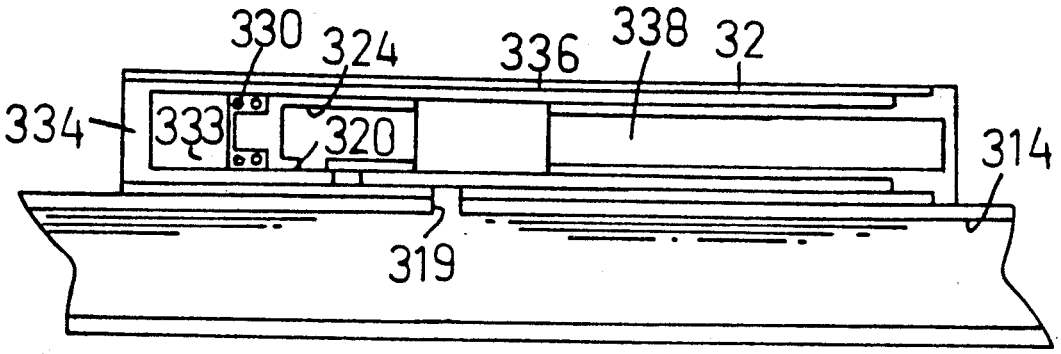

An alternative form of the invention for use in grenade launchers and other low pressure weapons is shown in FIGS. 8,9 and 10. In FIG. 8 the piston/valve (324) is shown at rest. When the weapon is fired, gas in barrel (314) behind projectile (312) enters the large gas port (319) in barrel (314), passing through the gas vent (320) in the piston/valve (324) within gas cylinder (336). When the gas reaches a pressure sufficient to overcome the valve spring (330), the piston valve (324) moves rearwardly (to the left in FIG. 8) sealing off the gas port (320), trapping the gas in the gas chamber (338) as shown in FIG. 9. This has taken place without any movement of the operating rod (334).

Some conventional gas systems employ a cut off of the gas, but in order to accomplish this, the operating rod must also move. If used with a low velocity grenade launcher such a system would pressurize, and then depressurize back into the barrel before the cut off action could occur.

In FIG. 9 the piston valve (324) is shown forced rearward, trapping the gas in the gas system. The only parts of the system having moved at this time are the piston valve (324) and spring (330). A buffer (333) is placed behind the piston valve (324) to absorb the impact of piston valve (324) against the operating rod (334). As shown in FIG. 9, in addition to trapping the gas in gas chamber 338, as piston valve (324) is moved rearward, to the left, the valve frontal circumferential surface is exposed to the gas pressure, giving the valve a larger exposed surface area.

In FIG. 10, the trapped gas is driving the operating rod (334) rearward. The projectile (312) has left the barrel (314) (to the right) in this view.

The operating rod (334) in FIGS. 8,9 and 10 provides power to cycle a weapon mechanism and will serve to operate any weapon mechanism type which requires linear forcing.

Figure 11:
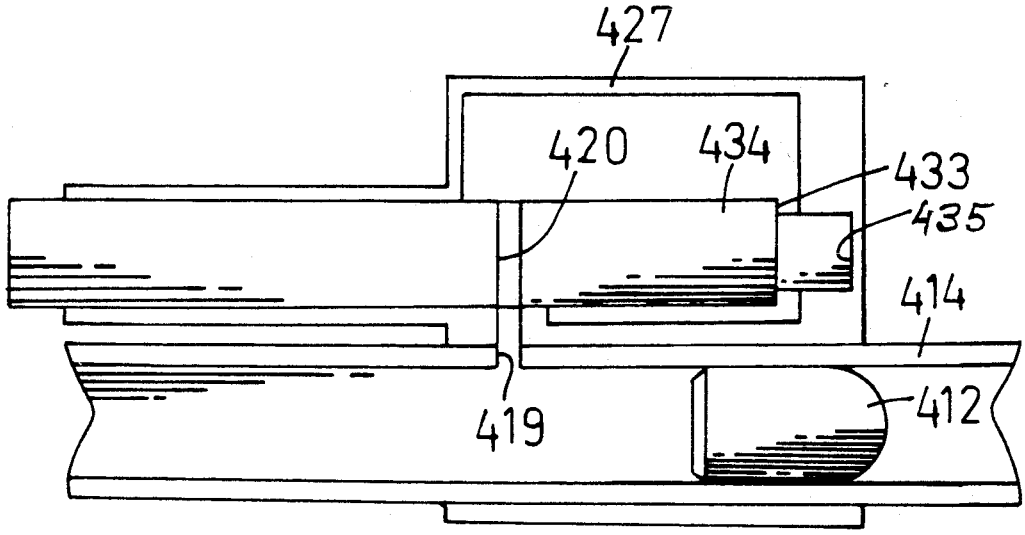
FIGS. 11 and 12 illustrate the operation of a fourth embodiment.
Figure 12:
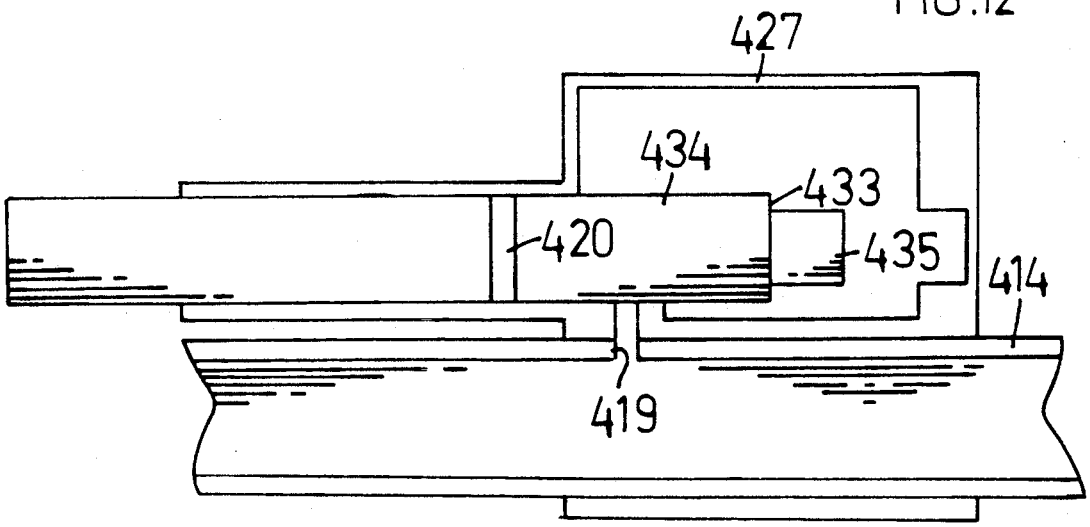

FIGS. 11 and 12 illustrate an embodiment of my invention in which a quantity of high pressure gas is permitted first to apply a relatively small force against the operating rod, followed by a timed larger force.

Since this disclosure does not concern locking systems themselves, but only gas powering systems, no locking system is pictured in these views.

Unlocking, in a typical gas operated weapon requires only minimal energy, compared to the energy required for extraction of the empty case, feeding, and operating the rest of the weapon. Therefore, in the present invention, only a small area of the operating rod is exposed to the pressurized gas, to provide a relatively small force during unlocking. After unlocking is accomplished and the operating rod is in contact with the unlocked bolt, the total frontal area of the operating rod/picton 434 is exposed to the pressurized gas to provide a relatively large force to the operating rod, belt etc. to accomplish the rest of the functioning cycle. This invention tailors the force applied to the operating rod to the work being done in the weapon mechanism. In so doing, this system eliminates the need to provide the operating rod with a mass relatively much larger than the bolt (4 to 5 times larger is typical in conventional systems). In conventional gas operated weapons, all or nearly all the operating energy is transferred from the pressurized gas to the operating rod where the energy is stored as kinetic energy. This stored kinetic energy unlocks the bolt, picks up the bolt, drives the feed mechanism, etc. During this process in a conventional system the operating rod, at high velocity, impacts the locking mechanism, bolt etc. transferring some of its energy to the bolt, with the combined bolt and operating rod continuing rearward with a velocity in accordance with the conservation of momemtum of the combined masses. In order to keep initial operating rod velocities controllable, and to avoid excessive battering of the impacting surfaces, the operating rods of conventional systems are typically relatively massive compared to the total weapon weight.

Since the operating rod of this invention need not be designed with a relatively large mass compared to the bolt, a signicantly lighter weapon can be designed.

In FIG. 11. the projectile (412) has passed the gas ports (419) in barrel (414) and (420) in operating rod (434). High pressure gas is filling the gas cylinder (427). With the gas cylinder (427) pressurized, gas acts only upon the larger diameter (433) of the operating rod (434) in the gas cylinder (427), but not on the front of smaller diameter (435) of the operating rod (434) which is not yet exposed to gas pressure. This means that only a relatively small rearward force is applied to the operating rod (434). This small force is used to move the operating rod rearward to close off the barrel gas port (419) and seal the gas in the gas cylinder (427). This small force is also used to unlock the weapon. The operating rod (434) is proportioned and timed so the smaller diameter (435) of the operating rod (434) enters the gas cylinder (427) as unlocking is completed and the operating rod (434) is in contact with the unlocked bolt, not shown. This is the condition in FIG. 12. At this time the full frontal area (433) and (435) of the operating rod (434) is exposed to the gas pressure, applying a large force to the operating rod (434) to complete the cycle of functioning. Since the volume of the gas cylinder (427) is relatively large compared to the volume displaced by the operating rod (434), the pressure drops relatively slowly as the operating rod (434) moves rearward. This provides an expansion ratio favorable to providing a sustained moderate force on the operating rod (434) throughout most of the rearward travel of the operating rod. The direct application of gas pressure throughout a large portion of the rearward stroke further reduces the requirement for a relatively heavy operating rod to power the weapon with kinetic energy, as in conventional systems.

While several embodiments of the present invention have been shown and described herein, it is to be understood that other modifications and improvements will occur to those skilled in the art and it is to be understood that these alterations and deviations from the disclosed embodiments are considered to be part of my invention as set forth in the following claims

What I claim is:

1. A stage gas system for cycling a weapon comprising:

a weapon having a barrel through which a projectile may be fired, said weapon having a gas cylinder with a piston therein and a bolt lockable forwardly, port means between said barrel and said gas cylinder to conduct gases thereto when said weapon is fired.

closure means for trapping said gases within said gas cylinder to prevent reverse gas flow when gas pressure in said barrel has diminished, said gases in said cylinder moving said piston rearwardly to unlock said bolt to permit rearward movement of said piston and said bolt, said piston having a second area of exposure to said gases after unlocking said bolt to create a different force to operate cycling functions of said weapon, said piston having a hollow bore to receive a greater volume of gases than a piston without said bore to supply a relatively greater initial force on said piston to accommodate a high cyclic rate weapon, and a second piston having a reduced frontal area exposed to said gases followed by an enlarged total frontal area of said second piston being exposed to said gases.

2. A staged gas system for cycling a weapon comprising:

a weapon having a barrel through which a projectile may be fired, said weapon having a gas cylinder with a piston therein and a bolt lockable forwardly, port means between said barrel and said gas cylinder to conduct gases thereto when said weapon is fired, closure means for trapping said gases within said gas cylinder to prevent reverse gas flow when gas pressure in said barrel is diminished, said gases in said cylinder moving said piston rearwardly to unlock said bolt to permit rearward movement of said piston and said bolt, said piston having a second area of exposure to said gases after unlocking said bolt to create a different force to operate cycling functions of said weapon, said piston having a bore therein terminating in a closed end and an end with a reduced opening, said gas cylinder having a plug fitting into said opening when said weapon is in battery position, said piston being movable to remove said end with reduced opening from said plug.

3. A staged gas system for cycling a weapon comprising, a weapon having a barrel through which a projectile may be fired, said weapon having a gas cylinder with a piston therein and a bolt lockable forwardly, port means between said barrel and said gas cylinder to conduct gases thereto when said weapon is fired, closure means for trapping said gases within said gas cylinder to prevent reverse gas flow when gas pressure in said barrel has diminished, said gases in said cylinder moving said piston rearwardly to unlock said bolt to permit rearward movement of said piston and said bolt, said piston having a second area of exposure to said gases after unlocking said bolt to create a different force to operate cycling functions of said weapon, said piston havinng a smaller diameter end engagable with a recess in said gas cylinder when in battery position, said smaler diameter being exposed to said gas pressure when said piston moves from battery position.

* * * * *